US007479177B2

(12) United States Patent
Church

(10) Patent No.: US 7,479,177 B2
(45) Date of Patent: Jan. 20, 2009

(54) COATING FOR COLD WORKING METALS

(75) Inventor: Richard J. Church, Berkley, MI (US)

(73) Assignee: Henkel AG & Co. KGaA (DE)

( * ) Notice: Subject to any disclaimer, the term of this patent is extended or adjusted under 35 U.S.C. 154(b) by 545 days.

(21) Appl. No.: 10/789,225

(22) Filed: Feb. 27, 2004

(65) Prior Publication Data

US 2004/0226629 A1 Nov. 18, 2004

Related U.S. Application Data

(63) Continuation of application No. PCT/US01/18261, filed on Jun. 6, 2001.

(60) Provisional application No. 60/209,663, filed on Jun. 6, 2000.

(51) Int. Cl.
*C22C 22/07* (2006.01)
*C22C 22/17* (2006.01)
*C10M 157/08* (2006.01)

(52) U.S. Cl. ..... 106/14.12; 106/14.13; 148/253; 148/256; 148/257; 148/259; 508/155; 508/159

(58) Field of Classification Search ..... 148/253, 148/257, 259–260, 274, 256; 106/14.12, 106/14.15, 14.13; 508/156, 155, 159
See application file for complete search history.

(56) References Cited

U.S. PATENT DOCUMENTS

| | | | | |
|---|---|---|---|---|
| 3,645,797 | A | 2/1972 | Lorin | |
| 4,289,546 | A | 9/1981 | Hacias | |
| 4,289,547 | A | 9/1981 | King et al. | |
| 5,368,757 | A | 11/1994 | King | |
| 5,531,912 | A | 7/1996 | Church et al. | |
| 5,547,595 | A | 8/1996 | Hacias | |
| 5,584,944 | A | 12/1996 | Bershas et al. | |
| 6,068,710 | A | 5/2000 | Hacias | |
| 6,248,701 | B1 | 6/2001 | Church | |
| 6,472,352 | B1 * | 10/2002 | Hacias | 508/155 |

FOREIGN PATENT DOCUMENTS

| | | | |
|---|---|---|---|
| SU | 681092 | | 8/1979 |
| SU | 874751 | | 10/1981 |
| WO | WO 98/23789 | * | 6/1998 |

* cited by examiner

*Primary Examiner*—Roy King
*Assistant Examiner*—Lois L. Zheng
(74) *Attorney, Agent, or Firm*—Mary K. Cameron

(57) ABSTRACT

The invention involves a composition for forming a combined conversion and lubricating coating on a metal substrate with which the composition is brought into contact. The composition comprises (a) an oxyethylated aliphatic alcohol whose aliphatic hydrocarbon moiety contains 18 or more carbon atoms and (b) dissolved phosphate anions. Preferably the composition also comprises inorganic boron, an alkali metal salt of a fatty acid, and an accelerator for phosphate coating.

16 Claims, No Drawings

COATING FOR COLD WORKING METALS

CROSS-REFERENCE TO RELATED APPLICATIONS

This application is a continuation under 35 USC Sections 365(c) and 120 of International Application No. PCT/US01/18261, filed 6 Jun. 2001 and published 13 Dec. 2001 in English as WO 01/94663, which claims priority from U.S. Provisional Application No. 60/209,663, filed 6 Jun. 2000, each of which is incorporated herein by reference in its entirety.

BACKGROUND OF THE INVENTION

1. Field of Invention

This invention relates to aqueous liquid combined conversion coating and lubricant coating compositions and to uses thereof. These compositions, in a single liquid-coating-forming contact with a metal substrate followed by drying into place on the metal substrate surface, produce a coating that combines both a solid adherent conversion coating and a solid and/or liquid lubricant and is highly effective in facilitating cold working of the thus-coated metal substrate in any type of cold working operation that requires deformation of the thus-coated surface of the object by relative motion between this coated substrate surface and a forming tool such as a drawing die.

2. Background Art

Many aqueous liquid compositions that form coatings on metal surfaces that protect the metal surface while it is being cold worked are known. The previously most effective ones have generally been zinc, calcium, and/or sodium soaps applied over a preceding heavy phosphate conversion coating on steel substrates or over a complex calcium aluminate conversion coating on aluminum substrates. (Normally, a sodium stearate or other sodium soap salt is applied over a zinc phosphate coating or a calcium aluminate coating. Reaction between the sodium soap and the zinc or calcium in the previous conversion coating is believed to result in both zinc or calcium soap and sodium soap layers, and this type of lubricant is accordingly often called a "reactive" lubricant.) However, this combination is environmentally disadvantageous, especially when used over phosphate coatings, because the liquid compositions used to form phosphate coatings generally contain some types of metal ions, such as those of zinc, nickel, manganese, and/or the like, that are regarded as polluting. Zinc and calcium soaps are substantially insoluble in water, but cause workplace nuisances at best and hazards at worst because they tend to form fine dust particles in the air around sites of cold working processes when used as cold working lubricants. This combination is also economically disadvantageous because it normally requires separate conversion coating and lubricant coating process steps, with associated requirements for equipment for large scale practice of cold working using this method of lubricating the metal substrates being worked.

Various polymer based lubricants have been taught in the art as replacements for the combination of stearates over zinc phosphate conversion coatings, but heretofore none of the polymer based lubricants have proved to be commercially acceptable in all applications. A frequently objectionable feature of commercial use of prior polymeric lubricants is the presence of scratches on the surface of the cold worked article.

Previous attempts to combine the best features of conversion coatings and other lubricants in a single step resulted in the issuance of U.S. Pat. Nos. 4,289,546 and 4,289,547, which have many disclosures in common, and in earlier patents cited in these two patents. In long term practice, the teachings of all of these patents proved to be commercially unacceptable for use on steel, which is the most common substrate treated for protection during cold working, because iron cations dissolved from the steel eventually accumulated in the working compositions to such an extent as to make their continued use unsatisfactory.

A major object of this invention is to provide lubricants and processes that will eliminate or at least reduce the environmental and other disutilities noted above while still achieving cold working performance that is adequate when compared with the prior art use of phosphate conversion coatings followed by zinc soap application. Other alternative or concurrent objects are to reduce total energy and/or other costs of cold forming operations, particularly by reducing process related waste of objects being cold worked, more particularly because of rejection for scratched surfaces, and/or by achieving higher production rates per unit time. Still another alternative or concurrent object is to provide a lubricant satisfactory for extruding under the more severe conditions in current commercial practice.

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, throughout this description, unless expressly stated to the contrary percent, "parts of", and ratio values are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ by chemical reactions specified in the description, and does not necessarily preclude other chemical interactions among the constituents of a mixture once mixed; specification of materials in ionic form additionally implies the presence of sufficient counterions to produce electrical neutrality for the composition as a whole (any counterions thus implicitly specified should preferably be selected from among other constituents explicitly specified in ionic form, to the extent possible; otherwise such counterions may be freely selected, except for avoiding counterions that act adversely to the objects of the invention); and the term "mole" and its grammatical variations may be applied to elemental, ionic, and any other chemical species defined by number and type of atoms present, as well as to compounds with well defined molecules.

SUMMARY OF THE INVENTION

A composition according to this invention for forming a combined conversion and lubricating coating on a suitable metal substrate with which the composition has been brought into contact comprises a combination of the following components:

(A) a component selected from the group consisting of ethoxylated or oxyethylated straight chain aliphatic alcohol molecules, wherein the initial alcohol molecules have a single —OH moiety and at least 18 carbon atoms; and (B) a component of dissolved phosphate anions. Optionally; one or more of the following components may also be present in the composition:

(C) a component selected from the group consisting of lithium salts, sodium salts, and potassium salts of fatty organic acids;

(D) a component selected from the group consisting of inorganic boron containing acids and salts thereof;

(E) a component of acidifying and/or alkalinizing agents for adjusting the pH of the composition, said acidifying and alkalinizing agents not being part of any of immediately previously recited components (A) through (D);

(F) a component of organic corrosion inhibitors that are not part of any of immediately previously recited components (A) through (E);

(G) a component of surfactant molecules that are not part of any of immediately previously recited components (A) through (F);

(H) a component of antifoam agent molecules that are not part of any of previously immediately recited components (A) through (G); and (J) a component of phosphate conversion coating accelerator.

Embodiments of the invention include working aqueous liquid compositions suitable for contacting directly with metal surfaces to provide protective coatings thereon after drying; liquid or solid concentrates that will form such working aqueous liquid compositions upon dilution with water only; processes of using working aqueous liquid compositions according to the invention as defined above to form protective coatings on metal surfaces and, optionally, to further process the metal objects with surfaces so protected; protective solid coatings on metal surfaces formed in such a process, and metal articles bearing such a protective coating. In addition to the essential ingredients noted above, working compositions according to the invention must be liquids and will of course contain water, but most if not all of the water is normally removed by drying before the lubricating coating formed in a process according to the invention is actually utilized for its major lubricating function in cold working.

DETAILED DESCRIPTION OF CERTAIN EMBODIMENTS OF THE INVENTION

The absolute concentrations of the various necessary, preferable, and optional ingredients in aqueous working or concentrate compositions according to the invention are not at all narrowly limited, and the preferences for concentrations of their predominant constituents are largely determined by the viscosity for both working and concentrate compositions. In a concentrate composition, the concentration of non-volatile ingredients preferably is as high as can be effectively utilized by the equipment available for removing the concentrate from its container and mixing the concentrate composition with water, and sometimes other materials, to form a working composition. In a working composition itself, the preferred viscosity is one that will form an at least temporarily adherent liquid film, on a substrate coated with the working composition, that when dried will contain the preferred amounts of non-volatile lubricant constituents. These preferred amounts vary widely with the exact choice of substrate and cold working conditions, but can readily be determined with minimal experimentation by those skilled in the art. The numerical preferences stated below are believed to be correct for most uses but should be regarded only as general guidelines for exceptional uses.

In a working aqueous composition according to the invention, the concentration of component (A) preferably is at least, with increasing preference in the order given, 0.5, 1.0, 2.0, 2.5, 2.9, 3.3, 3.7, 4.1, 4.4, 4.6, or 4.8% of the composition. There is no known technical disadvantage when the concentration of component (A) is as much as 15% but for economy this concentration preferably and independently of the preferred minimum concentration is not more than, with increasing preference in the order given, 13, 11, 9.5, 8.5, 8.0, 7.6, or 7.3% of the composition. If the concentration of component (A) is too low, the coating formed will not have adequate lubricity, while if the concentration of component (A) is too high in a composition according to the invention, the composition may become unstable on standing.

The molecules of component (A) preferably have a chemical structure that can be produced by condensing ethylene oxide with aliphatic monoalcohols that have, with increasing preference in the order given, at least 18, 25, 30, 35, 40, 43, 46 or 48 carbon atoms per molecule and independently, with increasing preference in the order given, not more than 65, 60, 57, 55, 52, or 51 carbon atoms per molecule. If the number of carbon atoms is too low, inadequate resistance of the lubricant in the coating to being extruded during cold working will usually be found, while if this number is too high, the total lubricity will often be too low. The aliphatic monoalcohols preferably are primary alcohols. Preferably, the aliphatic monoalcohols are straight chain alcohols. Independently, these actual or hypothetical precursor aliphatic alcohols preferably have no functional groups other than the single —OH moiety, and, optionally but less preferably, also fluoro and/or chloro moieties. Added functional groups lead to usually undesirable greater chemical reactivity, while halo substituents increase the cost of the composition without any corresponding benefit in most instances. Independently, it is preferred that the molecules of ethoxylated alcohols used in a composition according to this invention contain, with increasing preference in the order given, at least 20, 30, 35, 40, 43, 47, or 49%, and independently preferably contain, with increasing preference in the order given, not more than 80, 70, 62, 57, 54, or 51%, of their total mass in the oxyethylene units. If the percent of oxyethylene units is too large, lubrication will usually be inadequate, while if this number is too small, it will usually be unreasonably difficult, if possible at all, to prepare a storage-stable emulsion of the molecules of component (A) in water. In addition to ethylene oxide, minor amounts of cyclic ethers other than ethylene oxide (e.g., propylene oxide) may also be condensed with the aliphatic monoalcohol. Preferably, however, the molar ratio of ethylene oxide cyclic, ethers other than ethylene oxide is greater than 3:1, more preferably, greater than 5:1. Most preferably, no cyclic ethers other than ethylene oxide are employed.

Component (B) of phosphate anions preferably, at least for economy, is sourced to a composition according to the invention by at least one of orthophosphoric acid and its salts of any degree of neutralization. Component (B) can also be sourced to a composition according to the invention by pyrophosphate and other more highly condensed phosphates, including metaphosphate. At the preferred concentrations for at least working compositions according to the invention, all condensed phosphates tend to hydrolyze to orthophosphates. However, inasmuch as the condensed phosphates are usually at least as expensive as orthophosphates, there is little practical incentive to use them, except possibly to prepare extremely highly concentrated liquid compositions according to the invention, in which condensed phosphates may be more soluble. Whatever its source, the concentration of component (B) in a working composition according to the invention, measured as its stoichiometric equivalent as $PO_4^{-3}$ anions with the stoichiometry based on equal numbers of phosphorus atoms, preferably is at least, with increasing preference in the order given, 0.2, 0.4, 0.6, 0.80, 0.85, 0.90, 0.93, 0.96, or 0.99% of the composition and independently preferably is not more than, with increasing preference in the order given, 20, 10, 6.5, 5.0, 4.0, 3.5, 3.0, 2.6, 2.3, 2.1, or 1.9% of the composition. If the concentration of phosphate anions is too low, an inadequate conversion coating portion of the desired coating will usually result, while if the concentration of phosphate anions is too high, at least one of excessive sludging of solids from the composition during use or inadequate lubricity of the coating formed may be expected.

In component (C), the anions preferably contain a number of carbon atoms in each anion that is at least, with increasing preference in the order given, 10, 12, 14, 16, or 18 and independently preferably is not more than, with increasing preference in the order given, 40, 35, 30, 26, 24, 22, or 20. If this number of carbon atoms is too small, inadequate lubricity will usually result, while if this number is too large, the solubility of the salts in water is likely to be inadequate. The number of carbon atoms over the whole of component (C) will be averaged and therefore will not necessarily be integral, as will the number for each molecule, but the preferences for the average are the same as for the individual anions within the number of significant figures stated. Independently, salts of saturated acids and those without functional groups other than the necessary carboxylate group are preferred, to minimize susceptibility to degradation upon storage in contact with the ambient natural atmosphere. For both economy and good performance, salts of commercial stearic acid, which usually contains at least a few percent of palmitic acid also, and may contain small amounts of other fatty acids, are most preferred.

Although component (C) is not essential in the broadest embodiments of the invention, its presence is preferred, because the lubricity of the coatings formed is usually improved when this component is present. The cations in component (C) may be sodium, lithium, or potassium. The cations preferably are lithium. Independently, the total component (C), measured as its stoichiometric equivalent as lithium stearate with the stoichiometry being based on equal numbers of carboxylate anions, preferably has a ratio to component (A) that is at least, with increasing preference in the order given, 0.2:1.0, 0.4:1.0, 0.8:1.0, 1.2:1.00, 1.6:1.00, 1.8:1.00, or 2.0:1.00 and independently preferably is not more than, with increasing preference in the order given, 10:1.0, 8:1.0, 6:1.0, 5.0:1.00, 4.0:1.00, 3.5:1.00, 3.0:1.00, 2.6:1.00, or 2.2:1.00.

The presence of component (D) is also preferred although not essential for the broadest embodiments of the invention. At least one benefit of preferred component (D) is a buffering action that helps to stabilize the pH value of a composition according to the invention as the composition is used. Component (D) is preferably selected from the group consisting of metaboric acid (i.e., $HBO_2$), orthoboric acid ($H_3BO_3$), and alkali metal and ammonium salts of metaboric and orthoboric acids and of the hypothetical tetraboric acid (i.e., $H_2B_4O_7$). More preferably, component (D) is selected from orthoboric acid, salts of tetraboric acid, and salts of orthoboric acid; most preferably a mixture of orthoboric acid and tetraborate anions and, optionally, orthoborate anions is used, and in such a mixture the molar ratio of the total of orthoborate anions (if any) and of orthoboric acid to tetraborate anions preferably is, with increasing preference in the order given, at least 1.0:1.0, 2.0:1.0, 3.0:1.0, 3.5:1.0, 4.0:1.0, 4.5:1.0, 5.0:1.0, 5.4:1.0, 5.7:1.0, 5.9:1.0, or 6.0:1.0 and independently preferably is, with increasing preference in the order given, not more than 20:1.0, 15:1.0, 12:1.0, 10:1.0, 9:1.0, 8.0:1.0, 7.5:1.0, 7.0:1.0, 6.7:1.0, 6.4:1.0, or 6.1:1.0. Independently, the ratio of the total amount of boron in component (D), if any is present, to component (A) preferably is, with increasing preference in the order given, not less than 0.002:1.0, 0.005:1.0, 0.007:1.0, 0.009:1.0, 0.011:1.0, 0.013:1.0, 0.015:1.0, 0.017:1.0, 0.019:1.0, 0.021:1.0, 0.023:1.0, 0.027:1.0, 0.030:1.0, 0.035:1.0, 0.040:1.0, 0.045:1.0, 0.050:1.0, 0.055:1.0, 0.060:1.0, or 0.065:1.0 and independently preferably is not more than 1.0:1.0, 0.5:1.0, 0.3:1.0, 0.20:1.0, 0.17:1.0, 0.14:1.0, 0.11:1.0, 0.100:1.0, 0.090:1.0, 0.085:1.0, 0.080:1.0, 0.075:1.0, or 0.072:1.0.

The pH value of a working composition according to the invention preferably is at least, with increasing preference in the order given, 2.0, 2.5, 3.0, 3.3, 3.7, 4.0, 4.2, or 4.4 and independently preferably is not more than, with increasing preference in the order given, 8.0, 7.5, 7.0, 6.5, 6.0, 5.5, 5.0, or 4.7. If the pH value is too low, an undesirably large amount of iron will usually be dissolved from steel substrates being treated in a process according to the invention, while if the pH is too high, an adequate amount of conversion coating will not usually form within a practically reasonable time. In order to reach a pH value within the desired range, either acid or base may be added to the composition after most or all of its other ingredients have been mixed into it. If an acidifying agent is needed, phosphoric acid is generally preferred, provided that it can be added in sufficient amount to bring the pH to the desired range without exceeding the maximum preferred total phosphate anions concentration specified above. (Nitric acid would then be preferred.) If an alkalinizing agent is needed, sodium hydroxide is usually preferred as the least expensive alternative that does not introduce any possibly troublesome constituents into the composition, but any suitable alkalinizing agent could be used.

Aqueous compositions containing ethoxylated alcohols sometimes stain or otherwise discolor metal surfaces exposed to them. If this is undesirable, it can generally be prevented by including in the working composition a suitable corrosion inhibitor as an optional component (F). A particularly preferred component (F) comprises:

(F.1) a primary inhibitor component selected from the group consisting of non-sulfur-containing organic azole compounds, preferably organic triazoles, more preferably benzotriazole and/or tolyltriazole; and (F.2) a secondary inhibitor component selected from the group consisting of organic azoles that also contain mercapto moieties, preferably mercaptobenzothiazole or mercaptobenzimidazole.

With this preferred corrosion inhibitor, the concentration of component (F.1) in a working aqueous liquid composition according to this invention preferably is, with increasing preference in the order given, not less than 0.20, 0.50, 0.80, 1.10, 1.20, 1.30, 1.40, 1.50, or 1.60 parts per thousand (hereinafter usually abbreviated "ppt") of the total composition and independently, primarily for reasons of economy, preferably is, with increasing preference in the order given, not more than 30, 20, 10, 5.0, 4.0, 3.6, or 3.4 ppt. For a concentrate, these concentrations should be increased to correspond to the expected dilution factor when the concentrate is used to make a working composition.

Independently, as already noted above, it is preferred for component (F.1) to be selected from benzotriazole and tolyltriazole, and in fact a mixture of these two is more preferred than either of them alone. The amount of each of benzotriazole and tolyltriazole in a composition according to the invention, expressed as a percentage of the total of component (F.1), preferably is, with increasing preference in the order given, independently for each of these two triazoles, not less than 5, 10, 15, 20, 25, 30, 35, 38, 41, 43, 45, 47, 48, or 49% and independently preferably is, with increasing preference in the order given, not more than 95, 90, 85, 80, 75, 70, 65, 62, 59, 57, 55, 53, 52, or 51.%. These ratios, unlike the concentration preferences stated above, apply exactly to concentrates as well as to working compositions.

When present, the concentration of component (F.2) in a composition according to this invention preferably has a ratio to the concentration of component (F.1) in the same composition that preferably is, with increasing preference in the order given, not less than 0.001:1, 0.002:1.0, 0.004:1.0, 0.007:1.0, 0.015:1.00, 0.030:1.00, 0.040:1.00, 0.045:1.00, 0.050:1.00, 0.053:1.00, 0.056:1.00, 0.059:1.00, or 0.061:1.00 and independently preferably is, with increasing preference in the order given, not more than 2:1.0, 1:1.0, 0.5:1.0, 0.3:1.0, 0.2:1.0, 0.15:1.00, 0.10:1.00, 0.080:1.00, 0.070:1.00, 0.067:1.00, 0.065:1.00, or 0.063:1.00.

Optional components (G) and (H) as described above are not generally needed in a composition according to the invention and therefore are preferably omitted in such instances. However, in unusual instances, a wetting agent may be needed to promote uniform application of a liquid composition according to the invention to a substrate, and/or an antifoam agent may be needed to prevent excessive foaming during some part of a process. In any such instances, suitable materials for these purposes can be readily selected by those skilled in the art.

Optional component (J) of conversion coating accelerator preferably is present in a composition according to the invention, because without this component the coating formed usually has less desirable lubricating and other protective properties. The accelerator when present preferably is selected from the group consisting of: 0.3 to 4 grams of chlorate ions per liter of the total coating composition, this unit of concentration being used used freely hereinafter for any constituent of the coating composition and being hereinafter usually abbreviated as g/l; 0.01 to 0.2 g/l of nitrite ions; 0.05 to 2 g/l of m-nitrobenzene sulfonate ions; 0.05 to 2 g/l of m-nitrobenzoate ions; 0.05 to 2 g/l of p-nitrophenol; 0.005 to 0.15 g/l of hydrogen peroxide in free or bound form; 0.1 to 10 g/l of hydroxylamine in free or bound form; and 0.1 to 10 g/l of a reducing sugar. Preferably the accelerator includes a source of hydroxylamine in an amount that corresponds stoichiometrically to an amount of hydroxylamine sulfate (which has the chemical formula $(HO—NH_3)_2SO_4$) that is at least, with increasing preference in the order given, 0.02, 0.04, 0.06, 0.08, or 0.10% and independently preferably is not more than, with increasing preference in the order given, 1.0, 0.8, 0.6, 0.50, 0.40, 0.35, 0.30, or 0.25%. Particularly if the concentration of all hydroxylamine sources corresponds stoichiometrically to not more than 0.10%, accelerator component (J) preferably also includes m-nitrobenzene sulfonate anions in an amount, measured as its stoichiometric equivalent as sodium m-nitrobenzene sulfonate, that is at least, with increasing preference in the order given, 0.02, 0.04, 0.06, 0.08, or 0.10% and independently preferably is not more than, with increasing preference in the order given, 1.0, 0.8, 0.6, 0.4, 0.30, 0.20, or 0.15%.

For various reasons, almost always including at least a cost saving from elimination of an unnecessary ingredient, it is preferred that a composition according to this invention should be largely free from various materials often used in prior art compositions. In particular, compositions according to this invention in most instances preferably do not contain, with increasing preference in the order given, and with independent preference for each component named, more than 5, 4, 3, 2, 1, 0.5, 0.25, 0.12, 0.06, 0.03, 0.015, 0.007, 0.003, 0.001, 0.0005, 0.0002, or 0.0001% of each of (i) hydrocarbons, (ii) fatty oils of natural origin that have not been modified by chemical reaction from their naturally occurring form, (iii) other ester oils and greases that are liquid at 25° C., (iv) cations of any of zinc, calcium, or magnesium, (v) hexavalent chromium, (vi) nickel cations, (vii) cobalt cations, (viii) copper cations, (ix) manganese in any ionic form, (x) graphite, (xi) molybdenum sulfide, (xii) copolymers of styrene and maleic moieties, (xiii) oxidized polyethylene, (xiv) urethane polymers and copolymers, (xv) alkoxylates of Guerbet alcohols, (xvi) polyoxyalkylene polymers not containing an end group having at least 17 carbon atoms in a chain without any intervening carbon-oxygen bonds; and (xvii) at least partially neutralized copolymers of (xvii.i) an alkene that contains no carboxyl or carboxylate group and (xvii.ii) a comonomer that is an organic acid including the moiety C═C—COOH, such at least partially neutralized copolymers of organic acids often being denoted in the art generally as "ionomers". (For purposes of this description, the term "maleic moiety" is defined as a portion of a polymer chain that conforms to one of the following general chemical formulas:

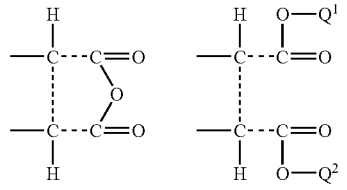

wherein each of $Q^1$ and $Q^2$, which may be the same or different, is selected from the group consisting of hydrogen, alkali metal, ammonium, and substituted ammonium cations.) For possible constituents (xii)-(xvii) as noted above, it is independently preferred that the ratio of the concentration in a composition according to the invention of each of these possible constituents to the concentration of necessary constituent (A) as noted above is, with increasing preference in the order given, not more than 2, 1.5, 1.0, 0.9, 0.8, 0.7, 0.6, 0.5, 0.4, 0.3, 0.2, 0.15, 0.10, 0.07, 0.05, 0.03, 0.02, 0.01, 0.007, 0.005, 0.003, or 0.002. However, all the preferences stated in this paragraph are subordinated to the explicit descriptions of specific materials herein as a necessary, preferred, or optional constituent of a composition according to this invention, so that a material specifically described as necessary, optional, or preferred may be present in a composition according to this invention even if it is a member of some larger class that is unpreferred as noted earlier in this paragraph.

A coating composition according to the invention is preferably maintained while coating a metal substrate in a process according to the invention at a temperature that is at least, with increasing preference in the order given, 30, 40, 50, 55, 60, 65, 69, or 73° C. and independently preferably is not more than, with increasing preference in the order given, 95, 90, 85, 80, or 75° C. Independently, the substrate during a process according to the invention preferably remains in contact with a composition according to the invention for a time that is at least 0.5, 1.0, 1.5, or 2.0 minutes (hereinafter usually abbreviated "min") and independently preferably, at least for economy, is not more than 20, 15, 10, 7, 5, or 3 min.

The specific areal density (also often called "add-on weight [or mass]") of a composition according to this invention, after application from a liquid composition to the metal surface and drying into place on the liquid-coated treated surface of the solid constituents of the liquid coating thus applied, preferably is, with increasing preference in the order given, at least 0.5, 1.0, 1.5, 2.0, 2.5, 3.0, 3.4, 3.7, 4.0, or 4.3 grams of dried lubricating composition per square meter of surface (this unit of areal density or add-on weight being hereinafter usually abbreviated as "$g/m^2$") and independently preferably is, with increasing preference in the order given, not more than 100, 80, 75, 70, 65, 60, 55, 50, 45, 40, 35, 30, 25, 20, 15, 13, or 11 $g/m^2$. The coating weight of lubricant only can be determined by weighing a coated substrate, removing the lubricant coating from the substrate with the aid of a water solution of detergent and a soft brush, then rinsing, drying, and reweighing to measure the weight of lubricant removed. The weight removed is then converted to coating weight by dividing by the area from which the weighed amount was removed.

Independently and in addition to the coating weight of the lubricant measured as described in the immediately preceding paragraph, in a process according to the invention the substrate coated preferably has a coating weight of phosphate conversion coating that is at least, with increasing preference in the order given, 0.3, 0.6, 0.9, 1.2, 1.5, 1.7, 1.9, or 2.1 $g/m^2$ and independently preferably is not more than, with increasing preference in the order given, 10, 8, 6, 5.0, 4.5, 4.0, 3.5, 3.0, or 2.5 $g/m^2$. The phosphate conversion coating weight may be measured, after the lubricant coating has been removed from a test substrate, by stripping the conversion coating in a solution of chromic acid in water as generally known in the art.

If the coating weight of either the conversion coating or the lubricant coating is too low, the coating formed will not provide adequate lubrication to prevent galling, seizing, or the like during severe cold working. If the coating weight of either the conversion coating or, especially, the lubricant coating is too high, there will be a substantially increased danger of occurrence of at least one of two undesirable phenomena known in the art as wash out or lube-burst. In wash out, parts of the exterior surface that have small radii of curvature, for example stamped identifying markings or sharp transitions between two distinct angles of taper, do not retain these features as desired after cold working, presumably because too thick a layer of coating has washed out the initially small radii of curvature into larger ones. In lube-burst, scratches are found on a drawn lubricated surface in a direction at least approximately perpendicular to the direction of drawing, whereas if scratches appear on inadequately lubricated surfaces, the scratches are at least approximately parallel to the direction of drawing.

Generally, in order to speed the drying process and possibly to promote some favorable chemical interaction among the nonvolatile components of a working composition according to this invention, it is preferred to expose the liquid coating formed in a process according to this invention to heat in the course of, or after, drying this liquid coating. The maximum temperature to which the coating is exposed preferably is, with increasing preference in the order given, not less than 30, 40, 50, 60, or 70° C. and independently preferably is, with increasing preference in the order given, not more than 180, 160, 150, 140, 130, or 120° C. Independently, the melting point of component (A) in the composition should not be exceeded; for the most preferred examples of component (A), the melting point is about 115° C. The time during which the coating is exposed to the maximum temperature used to dry it preferably is, with increasing preference in the order given, not less than 3, 5, 7, 10, 12, 14, 16, 17, 18, 19, or 20 min and independently preferably is, with increasing preference in the order given, not more than 90, 80, 70, 60, 55, 50, or 45 min. However, the process may also be satisfactorily applied with only drying in the ambient atmosphere, without any elevated temperature, particularly if the working treatment composition is applied while at a temperature that is at least, with increasing preference in the order given, 50, 60, 68, or 72° C.

Before treatment according to the invention, metal substrate surfaces preferably are conventionally cleaned, pickled, and/or rinsed, in a manner well known in the art for any particular type of substrate.

The practice of this invention may be further appreciated by consideration of the following, non-limiting, working examples, and the benefits of the invention may be further appreciated by reference to the comparison examples.

In these examples, the substrates were cylindrical steel tubes with outside diameters of 3.34 centimeters (this unit of length being hereinafter usually abbreviated as cm) and wall thicknesses of 0.356 cm. The tubes were made of American Society for Testing and Materials Type C1026 steel and were reduced during drawing to an outside diameter of 2.54 cm and a wall thickness of 0.274. Lots of five to ten tubes each were tested under each set of conditions described below.

Working Examples 1 and 2 and Comparison Example 1 had the compositions shown in Table 1 below. The ethoxylated alcohol used was UNITHOX D-300, which was commercially supplied by Petrolite Corp., Tulsa, Okla., USA, and is reported by its supplier to be a dispersion in water, with a solids content of 23.5±0.5% of condensation products of aliphatic monohydroxy primary alcohols with an average number of 50 carbon atoms per molecule with an approximately equal mass of ethylene oxide. ETHOMEEN S-15 (a surfactant) was obtained commercially from Akzo Chemie and was reported by its supplier to consist of products of condensation of ethylene oxide with primary soya amines.

TABLE 1

| | Concentration, as % of the Total Composition, for Ingredient in: | | |
|---|---|---|---|
| Ingredient | Comparison Example 1 | Example 1 | Example 2 |
| Ethoxylated alcohol | 4.7 | 7.3 | 4.7 |
| Boric acid | 1.13 | 3.0 | 1.13 |
| Sodium tetraborate decahydrate | 1.13 | none | 1.13 |
| Sodium hydroxide | 1.7 | none | 1.7 |
| 2-Mercaptobenzimidazole | 0.02 | none | 0.02 |
| Tolyltriazole | 0.8 | none | 0.8 |
| Benzotriazole | 0.8 | none | 0.8 |
| Lithium stearate | None | none | 0.99 |
| Sodium m-nitrobenzene sulfonate | None | none | 0.10 |
| Hydroxylamine sulfate | None | 0.25 | 0.10 |
| $NaH_2PO_4$ | None | 1.26 | 0.87 |
| 75% solution of $H_3PO_4$ in water | None | none | 1.65 |
| ETHOMEEN ™ S-15 | None | 1.00 | none |
| Water | Balance | Balance | Balance |

The tubes were conventionally cleaned and pickled, then coated with a working composition as shown in Table 1. The coated tubes were then dried and baked at 82-90° C. for 45 minutes before being drawn. After being drawn, the tubes were examined for surface quality and the drawing dies examined for any accumulation of metal on the dies. If there were no visible scratches on the drawn surface of the tubes and no accumulation of metal particles on the drawing dies, the tube drawing was rated as successful. The success rate was 100% for both Examples 1 and 2 and only 33% for Comparison Example 1.

What is claimed is:

1. A composition for forming a combined conversion and lubricating coating on a metal substrate with which the composition is brought into contact, the composition comprising:

at least one oxyethylated aliphatic alcohol whose aliphatic hydrocarbon moiety contains 18 or more carbon atoms in an amount of about 0.5 to about 15 wt % of the composition;

dissolved phosphate anions having a concentration of at least 0.2 wt % and not more than about 20 wt % of the composition; and a component selected from the group consisting of lithium salts, sodium salts, and potassium salts of fatty organic acids, wherein anions of the fatty organic acids include at least 10 carbon atoms, and cations are selected from the group consisting of sodium, lithium, and potassium; said component present in an amount, measured as its stoichiometric equivalent as lithium stearate with the stoichiometry being based on equal numbers of carboxylate anions, such that said component has a ratio to said at least one oxyethylated aliphatic alcohol that is at least 0.2:1.0 and not more than 10:1.0.

2. The composition for forming a combined conversion and lubricating coating claimed in claim 1 wherein the oxyethylated aliphatic alcohol is produced by condensing ethylene oxide with at least one primary straight chain aliphatic monoalcohol having at least 18 carbon atoms.

3. The composition for forming a combined conversion and lubricating coating claimed in claim 1 wherein the oxyethylated aliphatic alcohol has a concentration of at least 0.5% of the composition.

4. The composition for forming a combined conversion and lubricating coating claimed in claim 1 wherein oxyethylene units comprise at least 20% of the total mass of the oxyethylated aliphatic alcohol.

5. The composition for forming a combined conversion and lubricating coating claimed in claim 1 wherein the phosphate anions have a concentration of between about 0.99% -1.9% of the composition.

6. The composition for forming a combined conversion and lubricating coating claimed in claim 1 wherein:

said component selected from the group of lithium salts, sodium salts, and potassium salts of fatty organic acids, is a lithium salt.

7. The composition for forming a combined conversion and lubricating coating claimed in claim 1 further comprising at least one inorganic boron containing compound in an amount effective to stabilize the pH value of the composition, the at least one inorganic boron containing compound being selected from the group consisting of inorganic boron containing acids and salts of inorganic boron containing acids, the ratio of the boron to the at least one oxyethylated aliphatic alcohol being not less than 0.002:1.0.

8. The composition for forming a combined conversion and lubricating coating claimed in claim 1 further comprising at least one agent for adjusting the pH of the composition selected from the group consisting of acidifying agents and alkalinizing agents, the pH value of the composition being at least 2.0.

9. The composition for forming a combined conversion and lubricating coating claimed in claim 1 further comprising an organic corrosion inhibitor, the organic corrosion inhibitor comprising a primary inhibitor and a secondary inhibitor, the primary inhibitor being selected from the group consisting of non-sulfur-containing organic azole compounds and the secondary inhibitor being selected from the group consisting of organic azoles that contain mercapto moieties.

10. The composition for forming a combined conversion and lubricating coating claimed in claim 1, further comprising a surfactant in an amount effective to promote uniform application of the composition to the substrate.

11. The composition for forming a combined conversion and lubricating coating claimed in claim 1 further comprising an anti-foam agent in an amount effective to prevent excessive foaming.

12. The composition for forming a combined conversion and lubricating coating claimed in claim 1 further comprising a phosphate conversion coating accelerator, the accelerator being selected from the group consisting of: 0.3 to 4 grams of chlorate ions per liter of the total coating composition; 0.01 to 0.2 g/l of nitrite ions; 0.05 to 2 g/l of m-nitrobenzene sulfonate ions; 0.05 to 2 g/l of m-nitrobenzoate ions; 0.05 to 2g/l of p-nitrophenol; 0.005 to 0.15 g/l of hydrogen peroxide in free or bound form; 0.1 to 10 g/l of hydroxylamine in free or bound form; and 0.1 to 10 g/l of a reducing sugar.

13. The composition for forming a combined conversion and lubricating coating claimed in claim 1 wherein the at least one oxyethylated aliphatic alcohol contains an aliphatic hydrocarbon moiety having 30 to 60 carbon atoms per molecule.

14. The composition for forming a combined conversion and lubricating coating claimed in claim 1 wherein oxyethylene units comprise 30 to 70% of the total mass of the oxyethylated aliphatic alcohol.

15. The composition for forming a combined conversion and lubricating coating claimed in claim 1 further comprising:

at least one inorganic boron containing compound selected from the group consisting of inorganic boron containing acids and salts of inorganic boron containing acids, the ratio of the total amount of boron to the at least one oxyethylated aliphatic alcohol being not less than 0.002:1.0 and not more than 1.0:1.0;

a phosphate conversion coating accelerator, the accelerator comprising a source of hydroxylamine in an amount that corresponds stoichiometrically to an amount of hydroxylamine sulfate that is at least 0.02 and not more than 1.0 wt %.

16. The composition for forming a combined conversion and lubricating coating claimed in claim 15 further comprising m-nitrobenzene sulfonate anions in an amount, measured as its stoichiometric equivalent as sodium m-nitrobenzene sulfonate, that is at least 0.02 wt % and is not more than 1.0 wt %.

* * * * *